US009346088B2

(12) United States Patent
Thiele

(10) Patent No.: US 9,346,088 B2
(45) Date of Patent: May 24, 2016

(54) METHOD FOR ROLLING PLATES, COMPUTER PROGRAM, DATA CARRIER AND CONTROL DEVICE

(75) Inventor: Konrad Thiele, Hemhofen (DE)

(73) Assignee: PRIMETALS TECHNOLOGIES GERMANY GmbH, Erlangen (DE)

( * ) Notice: Subject to any disclaimer, the term of this patent is extended or adjusted under 35 U.S.C. 154(b) by 257 days.

(21) Appl. No.: 14/119,998

(22) PCT Filed: May 4, 2012

(86) PCT No.: PCT/EP2012/058180

§ 371 (c)(1),
(2), (4) Date: Nov. 25, 2013

(87) PCT Pub. No.: WO2012/159864

PCT Pub. Date: Nov. 29, 2012

(65) Prior Publication Data

US 2014/0076014 A1 Mar. 20, 2014

(30) Foreign Application Priority Data

May 24, 2011 (EP) ..... 11167293

(51) Int. Cl.
*B21B 1/22* (2006.01)
*B21B 39/16* (2006.01)

(52) U.S. Cl.
CPC . *B21B 1/22* (2013.01); *B21B 39/16* (2013.01); *B21B 2273/14* (2013.01)

(58) Field of Classification Search
CPC ..... B21B 1/22; B21B 39/16; B21B 39/14; B21B 2273/14; B21B 2273/12
See application file for complete search history.

(56) References Cited

U.S. PATENT DOCUMENTS 5,038,594 A 8/1991 Svagr et al.
5,195,345 A 3/1993 Porombka et al.

(Continued)

FOREIGN PATENT DOCUMENTS

CN 1036519 10/1989
CN 1048508 1/1991
CN 1365304 8/2002

(Continued)

OTHER PUBLICATIONS

English language of International Search Report for PCT/EP2012/058180, mailed Jul. 19, 2012, 2 pages.

(Continued)

*Primary Examiner* — Teresa M Ekiert
(74) *Attorney, Agent, or Firm* — Staas & Halsey LLP

(57) ABSTRACT

Trouble-free operation of an installation for rolling plates or sheets that have lost their rectangular form and have the form of a parallelogram is ensured by preventing the plate from meandering as it enters a rolling stand. A first rolling pass is carried out and, when the plate runs out from the rolling stand, it is determined whether the side faces of the plate are offset in relation to one another in the rolling direction. If the side faces of the plate are offset in relation to one another in the rolling direction, i.e. if the plate is parallelogram-shaped and has an oblique end, in a second rolling pass guiding elements of the rolling stand are set asymmetrically with respect to a center line. A first guiding element for the side face, which is the first to enter the rolling stand in the second rolling pass, is thereby adjusted further away from the center line than the second guiding element.

12 Claims, 2 Drawing Sheets

(56) References Cited

U.S. PATENT DOCUMENTS

| | | | |
|---|---|---|---|
| 6,688,151 | B2 | 2/2004 | Hiura et al. |
| 2003/0097866 | A1 | 5/2003 | Hiura et al. |

FOREIGN PATENT DOCUMENTS

| | | |
|---|---|---|
| CN | 1553832 | 12/2004 |
| CN | 101426593 | 5/2009 |
| DE | 69829454 | 4/2006 |
| EP | 0369269 | 5/1990 |
| EP | 0925854 | 6/1999 |
| EP | 11167293.7 | 5/2011 |
| JP | 61-108415 | 5/1986 |
| WO | PCT/EP2012/058180 | 5/2012 |

OTHER PUBLICATIONS

European Office Action for European Priority Patent Application No. 11167293.7, issued Dec. 16, 2011, 4 pages.

Chinese Office Action for related Chinese Patent Application No. 2012800243835, issued Sep. 28, 2014, 13 pages.

METHOD FOR ROLLING PLATES, COMPUTER PROGRAM, DATA CARRIER AND CONTROL DEVICE

CROSS REFERENCE TO RELATED APPLICATIONS

This application is based on and hereby claims priority to International Application No. PCT/EP2012/058180 filed on May 4, 2012 and European Application No. 11167293.7 filed on May 24, 2011, the contents of which are hereby incorporated by reference.

BACKGROUND

The invention relates to a method for rolling plates by at least one rolling stand.

In order to allow the edges of a rectangular plate to be aligned when it is guided into a rolling stand of a sheet rolling mill, lateral guiding elements are provided which ensure the linear and symmetrical course of the plate. The guiding elements have a centering function and effectively act as a "barrier" thereafter. Said guiding elements do not abut the side faces of the plate in this case, but are positioned at a distance from the side faces such that gaps having a width of several centimeters, in particular 3 to 5 cm, are formed between the guiding elements and the side faces of the plates. When rolling rectangular plates or sheets, it often occurs that the edges of the plates are not aligned when they enter the roll gap of the rolling stand of the sheet rolling mill. This situation can arise if the friction differs in the various regions of the rolled plate, for example. As a result of this, the plate is no longer right-angled after the rolling pass, but assumes the shape of a parallelogram. This effect is further amplified in the next rolling pass, since the plate is initially grasped on only one side of the roll gap and therefore transverse forces occur. As a result of the transverse forces, the plate is however rotated relative to the rolling direction, to the extent that this allowed by the guiding elements. Within these limits, the plate therefore runs obliquely into and through the roll gap.

The above-described phenomenon results in significant instabilities and problems which can adversely affect the production, particularly when rolling thin and wide plates. Various existing methods endeavor to ensure that plates which have lost their squareness are as aligned as possible when guided into the roll gap. According to one possibility, plates whose width is greater than their length in a rolling direction are thrust into the roll gap at excessive speed and thereby aligned. A further possibility is to move the guiding elements as close together as possible, though this is limited because the plates are generally wider at the leading and trailing ends, and become jammed in the side guide.

SUMMARY

One potential object is to ensure a trouble-free rolling process for plates and sheets, even if their ends are oriented obliquely relative to the rolling direction as a result of the rolling.

The inventor proposes a method for rolling plates by at least one rolling stand, wherein the rolling stand features a guiding element on the drive side and operator side respectively for the purpose of centering the plates, and the guiding elements are arranged symmetrically in relation to a center line of the rolling stand, said center line extending in a rolling direction, wherein a first rolling pass is carried out and provision is made for detecting whether the side faces of the plate are offset relative to each other in a rolling direction when the relevant plate emerges from the rolling stand, the plate is centered before a second rolling pass, wherein the guiding elements abut the plate in a centering position, and if the side faces of the plates are offset relative to each other in a rolling direction, after centering, the guiding elements are set asymmetrically relative to the center line in a second rolling pass, such that a first guiding element, for the side face which enters the rolling stand first in the second rolling pass, is so adjusted as to be further from the center line than the second guiding element.

A first rolling pass here is not understood to mean the very first rolling pass when processing the plate in the sheet rolling mill, but the chronologically first of any two directly consecutive rolling passes in the context of the rolling process. A "second rolling pass" correspondingly designates the chronologically later of two directly consecutive rolling passes.

When the plate emerges from the roll gap of a rolling stand, provision is made for predicting how the subsequent entry into the next roll gap will proceed and in which direction the plate will rotate if no countermeasures are taken. If the direction of rotation of the plate at the second rolling pass is known, corresponding countermeasures are introduced via the guiding elements.

According to existing methods, after centering and when the plate reaches the next roll gap, the guiding elements are moved symmetrically to a distance from the plate, thereby forming a tolerance gap of in particular 3 to 5 cm on both sides of the plate. In this case, if one side face of the plate is grasped more quickly by the roll gap than the opposite side face, the plate is rotated in the direction of its "slower" side, i.e. in the direction of the side face which enters the roll gap second. It strikes against the corresponding guiding element in this case.

According to the proposal, after each rolling pass during the rolling process in the sheet rolling mill, provision is made for checking whether the side faces of the emerging plate are offset relative to each other in a rolling direction and therefore the plate has the shape of a parallelogram with at least one oblique end. If it is found that the ends of the plate after the previous rolling pass are no longer transverse relative to the rolling direction, the guiding elements are asymmetrically set at the next rolling pass, such that the guiding element against which the plate would strike when it rotates upon entering the second rolling stand remains closer to the plate and therefore the plate cannot perform its rotation. In this way, the method primarily aims to prevent a further deformation of plates which have already lost their right-angled shape.

In this case, the second guiding element preferably remains in its centering position for that side face which enters the rolling stand second in the second rolling pass. This means that the second guiding element abuts that side face of the plate which is oriented towards it. In other words, the guiding element is positioned such that the distance between it and the center line corresponds substantially to the distance between the center line and the side faces if the plate were arranged symmetrically, such that the guiding element presses against the second side face when the first side face enters the roll gap, and consequently prevents the plate from sluing at the start of the rolling pass.

According to a preferred embodiment, provision is made for setting a tolerance gap having a width of a few centimeters, in particular 6 to 10 cm, between the first guiding element and that side face of the plate which is oriented towards it. The "opening" of the guiding element for the side face which enters the roll gap first is performed for safety reasons in order that the plate does not jam.

According to a preferred variant, a rolling force is measured on both drive side and operator side in order to check whether the side faces of the plate are offset relative to each other in a rolling direction. If the rolling force at the ends of the plate is not identical on the drive side and operator side, this means that the ends of the plate are oblique in relation to a rolling direction. This information concerning the ends of the plate is determined when the plate emerges after the first rolling pass. The guiding elements are set correspondingly so as to be asymmetrical at the next rolling pass in order to prevent the plate from sluing.

Only during the entry of a leading end of the plate is the arrangement of the guiding elements important in relation to the orientation of the plate during the entirety of the rolling pass. If an identical rolling force is set on both drive side and operator side, the plate is simply pulled forwards independently of the guiding elements. In order to prevent unnecessary frictional forces from being generated between one of the side faces and one of the guiding elements, the guiding elements in a further preferred embodiment are set symmetrically again at a slight distance of in particular 3 to 5 cm from the side faces after the second side face has entered the rolling stand.

Sheet rolling mills may comprise a plurality of rolling stands arranged one behind the other in a rolling direction. If just one rolling pass is carried out at each rolling stand, this means that the plate is only ever conveyed in one direction during its processing in the sheet rolling mill, and therefore the same end represents the leading end of the plate at each rolling pass. In such a sheet rolling mill, if an offset of the side faces of the plate in a rolling direction has been identified, guiding elements of the respectively next rolling stand are preferably likewise set asymmetrically during the entry of the plate after the plate has been centered. Therefore if the plate has already assumed the shape of a parallelogram, further deformation of the plate is counteracted by the asymmetrical setting of the guiding elements of the individual rolling stands during each further rolling pass in a rolling direction.

Alternatively, the sheet rolling mill may comprise at least one reversible rolling stand at which a plurality of rolling passes are carried out, i.e. the rolling direction is repeatedly reversed. In this case, both ends of the plate alternately represent the leading end. If the plate is rolled by least one reversible rolling stand, an advantageous embodiment provides for the guiding elements of the reversible rolling stand to be adjusted correspondingly when the rolling direction changes. With reference to the current leading end, provision is therefore made for continuously taking into consideration that side face which enters the roll gap first, and in a corresponding manner the guiding element on this side of the plate is opened while the second guiding element continues to abut the plate.

The inventor also proposes a computer program comprising machine code, whose execution by a control device for a rolling stand causes the rolling stand to be operated in accordance with a method as per one of the embodiments described above.

The inventor proposes a data carrier, on which such a computer program is stored in machine-readable format.

The inventor proposes a control device for a rolling stand, in which such a computer program is stored and can be executed by the control device.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
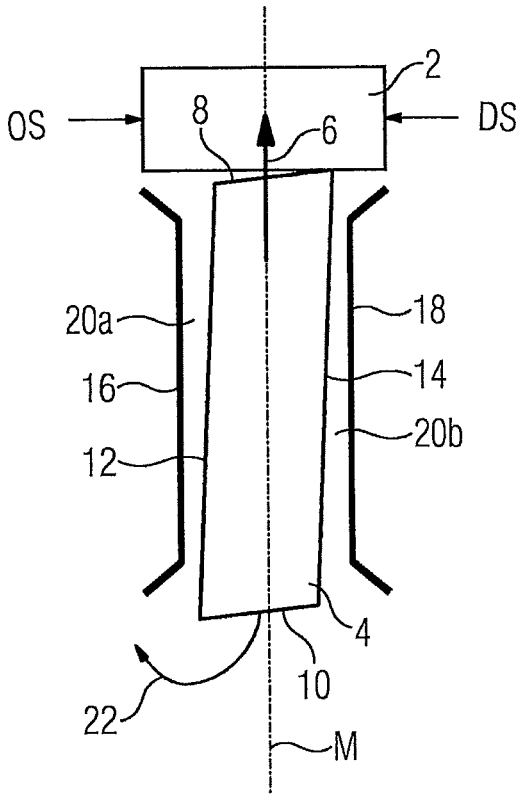
FIG. 1 shows a parallelogram-shaped plate entering a rolling stand.

Reference will now be made in detail to the preferred embodiments of the present invention, examples of which are illustrated in the accompanying drawings, wherein like reference numerals refer to like elements throughout.

Identical reference signs have the same significance in the various figures.

FIG. 1 symbolically illustrates a rolling stand 2 which forms part of a sheet rolling mill (not shown in greater detail here) and is used to roll a plate 4. The rolling stand 2 is characterized by a drive side DS and an operator side OS. The sheet rolling mill comprises a plurality of such rolling stands 2, these being arranged one behind the other along a center line M in a rolling direction 6. The plate 4 is conveyed in the rolling direction 6 during the rolling, wherein each next rolling pass is normally carried out at the respectively next rolling stand 2 in the rolling direction 6.

Figure 2:
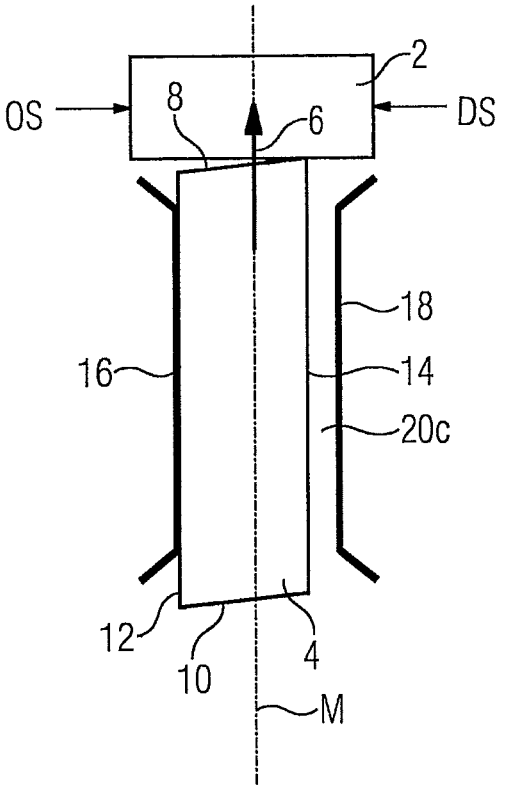
FIG. 2 shows the plate as per FIG. 1 and an asymmetrical setting of guiding elements.

The plate 4 has two ends 8, 10 and two side faces 12, 14. Depending on which of the ends enters the respective rolling stand 2 first or second, the ends are designated as leading end and trailing end. The leading end according to FIG. 1 and FIG. 2 is the end 8 and the trailing end is the opposite end 10.

The plate 4 is ideally rectangular. In this case, a rectangular plate is introduced into a roll gap (not shown in detail) of the rolling stand 2 such that its edges are aligned when it is processed. Two guiding elements 16, 18 are provided for guiding the plate 4 centrally and are so arranged as to be parallel with the center line M. The guiding elements 16, 18 abut the plate 4. When the plate 4 reaches the roll gap, the guiding elements 16, 18 are adjusted such that a small tolerance gap 20*a*, 20*b* of a few centimeters is formed between each guiding element 16, 18 and that side face 12, 14 which is oriented towards it. During normal operation of the rolling stand 2, the width of the tolerance gap is approximately 3 cm in the case of a right-angled plate 4.

However, it may occur that the plate 4 swivels relative to the center line M during operation, and enters the roll gap of the rolling stand 2 thus. Following a rolling pass, the plate 4 is then no longer right-angled, but has the shape of a parallelogram. At the next rolling pass, the leading end 8 of the plate 4 is oriented obliquely relative to the roll gap, such that the plate 4 enters the rolling stand with one edge first, this being the drive-side edge of the end 8 according to FIG. 1. As a result of the rolling forces acting in the region of the drive-side edge of the end 8, the plate 4 is slued in the direction of the operator side OS. This sluing movement is indicated by the arrow 22 in FIG. 1. The plate 4 may strike against the operator-side guiding element 16 when it rotates.

Figure 3:
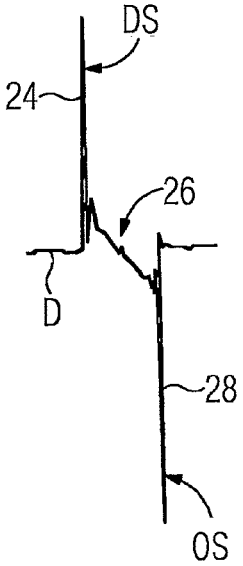
FIG. 3 shows a signal of a differential rolling force measured in the situation according to FIG. 1.
Figure 4:
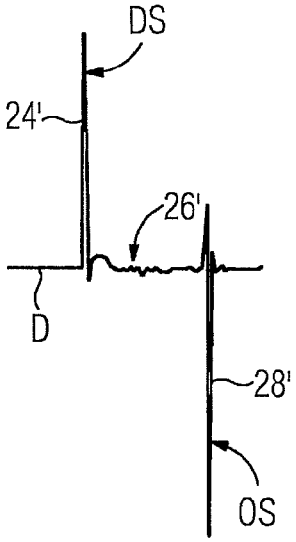
FIG. 4 shows a signal of the differential rolling force measured in the situation according to FIG. 2.
Figure 5:
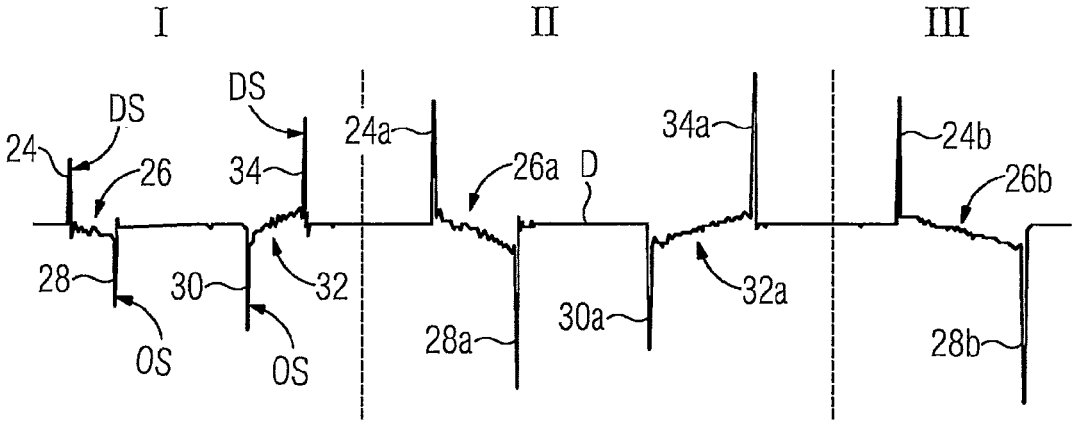
FIG. 5 shows the signal of the differential rolling force over a plurality of rolling passes in the situation according to FIG. 1.

In order to prevent a collision between the plate 4 and one of the guiding elements 16, 18 if the plate has lost its rectangular shape, the shape of the plate 4 is determined after each rolling pass when the plate 4 emerges from the roll gap of the respective rolling stand 2. This is done by measuring the rolling force on both the operator side OS and on the drive side DS of the rolling stand 2. A differential measured value D is derived from the two measured values and output as shown in FIG. 3, FIG. 4 and FIG. 5. The profile of the differential rolling force in the situation according to FIG. 1 is shown in FIG. 3. Since the plate 4 enters the roll gap with its drive-side edge first, the signal for the differential rolling force D exhibits a first peak 24 at the instant the rolled plate 4 enters the roll gap, since high forces are already acting on the plate 4 and/or on the rollers of the rolling stand 2 on the drive side, while no contact between the rollers and the plate 4 has yet taken place on the operator side. The region 26 of the signal for the differential rolling force D according to FIG. 3 illustrates the entry of the leading end 8 into the roll gap. The peak 28 marks the instant at which the operator-side edge of the end 8 of the plate 4 is also located in the gap of the rolling stand 2.

The temporal profile of the differential rolling force D over a plurality of rolling passes I, II and III is shown in FIG. 5. The first rolling pass I shows the profile of the differential rolling force D in the situation according to FIG. 1. The profile of the differential rolling force D during the entry of the plate 4 into the rolling stand 2 was already explained with reference to FIG. 3 in this case. The second half of the profile of the differential rolling force D during the first rolling pass I represents the emergence of the rolled plate 4 from the roll gap. The peak 30 shows a large difference in the rolling force between the operator side OS and the drive side DS at the instant at which the drive-side edge of the trailing end 10 leaves the roll gap. The region 32 illustrates the gradual emergence of the trailing end 10 of the plate 4 from the rolling stand 2. After the peak 34, the plate 4 is located completely outside the roll gap.

With reference to the further profile of the differential rolling force D during the second and the third rolling pass II, III, the regions 26*a*, 26*b* and 32*a* clearly tend to become increasingly steep, indicating that the angularity of the ends 8, 10 becomes ever greater as they enter and emerge from the roll gap, i.e. that the plate 4 becomes more distorted with each additional rolling pass.

In order to prevent such a deformation of the parallelogram-shaped plate 4, the guiding elements 16, 18 are positioned asymmetrically relative to the center line M, such that the plate 4 cannot perform a sluing movement 22. This is shown in FIG. 2. Since the rolling force is measured at each rolling pass, changes in the geometry of the plate 4 which have taken place during the rolling can be identified when the plate 4 emerges from the roll gap. If an oblique position of the ends 8, 10 of the plate 4 is detected, the operator-side guiding element 16 continues to abut the side face 12 in the next rolling pass at the next rolling stand 2 in a rolling direction 6. As a result of this arrangement, the plate 4 can no longer rotate in the direction of the arrow 22 as per FIG. 1 when it enters the roll gap.

At the same time, the distance is increased between the drive-side guiding element 18 and that side face 14 of the plate 4 which is oriented towards it. In this way, a tolerance gap 20*c* is produced whose width is substantially twice that of the original tolerance gaps 20*a*, 20*b* for a trouble-free rolling process involving a rectangular plate 4 which is disposed symmetrically relative to the center line M.

The profile of the differential rolling force D in the arrangement according to FIG. 2 is illustrated in FIG. 4. It is evident from FIG. 4 that the drive-side edge of the end 8 enters the roll gap before the operator-side edge of the end 8, i.e. that the side faces 12, 14 are offset relative to each other in a rolling direction 6, yet the asymmetric arrangement of the guiding elements 16, 18 nonetheless ensures that the side faces 12, 14 remain parallel with each other and parallel with the center line M during the entry of the plate 4. It is not possible thereby to reproduce the rectangular shape of the plate 4, but further distortion of the plate 4 during the rolling pass is prevented.

Once the leading end 8 has fully entered the roll gap, there is no further danger of the plate swiveling in direction 22. After the end 8 has entered the rolling stand, i.e. after the second side face 12 has also entered the rolling stand, the guiding elements 12, 14 are therefore adjusted such that they are again symmetrical relative to the center line M and at a distance from the plate 4.

The adjustment of the guiding elements 12, 14 is carried out by a control device (not shown in detail here), which outputs a control signal to the guiding elements 16, 18 as a function of the measured signal of the rolling forces at the operator side OS and the drive side DS or as a function of the differential rolling force D.

In this case, the asymmetric setting of the guiding elements 12, 14 during the entry of the plate 4 is performed at each further rolling stand 2 in the rolling direction 6.

The rolling stand 2 may also be operated in a reversible manner, such that a plurality of rolling passes take place at this one rolling stand 2. The rolling direction is changed after a first rolling pass in this case, becoming the opposite to that indicated by the arrow 6. The end 10 which was previously the trailing end of the plate 4 therefore becomes the leading end of the plate 4. During the second rolling pass at the rolling stand 2, it must therefore be taken into consideration that the operator-side side face 12 is now situated ahead of the drive-side side face 14 in the rolling direction, such that rotation of the plate in the direction of the drive-side guiding element 18 can be expected. In this case, the drive-side guiding element 18 is brought up against the side face 14 before the plate 4 enters the rolling stand 2 and the operator-side guiding element 16 is moved further away from the center line M again.

Further distortion of the plate 4 is prevented by virtue of the arrangement of the guiding elements 16, 18 as per FIG. 2, thereby both reducing material wastage during the manufacture of the plate 4 and ensuring trouble-free operation of the rolling stands 2.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A method for rolling a plate, comprising:

providing at least one rolling stand, the at least one rolling stand having a pair of rollers through which the plate rolls, the at least one rolling stand also having first and second guiding elements upstream from the rollers, the first and second guiding elements opposing one another and being provided on either side of a center line of the at least one rolling stand, the first guiding element being adjacent to a first side face of the plate, the second guiding element being adjacent to a second side face of the plate;

performing a first rolling pass through the rollers of the at least one rolling stand;

detecting whether the first and second side faces of the plate are offset from one another in a rolling direction when the plate emerges from the first rolling pass; and centering the plate before a second rolling pass, wherein the guiding elements abut the plate in a centering position, and after centering the plate, adjusting positions of the guiding elements before the second rolling pass such that if the first and second side faces of the plate are offset from one another when the plate emerges from the first rolling pass, the guiding elements are shifted such that:

if the first side face of the plate emerges first, the first guiding element is positioned further from the center line than the second guiding element when the plate enters the rollers at a beginning of the second rolling pass, and if the second side face of the plate emerges first, the second guiding element is positioned further from the center line than the first guiding element when the plate enters the rollers of the second rolling pass.

2. The method as claimed in claim 1, wherein the first and second rolling passes are performed at the at least one rolling stand and a second rolling stand, respectively.

3. The method as claimed in claim 1, wherein the first and second rolling passes are performed at the at least one rolling stand.

4. A method for rolling a plate by at least one rolling stand, wherein the at least one rolling stand features a first and second guiding elements for centering the plates, and the first and second guiding elements are arranged symmetrically in relation to a center line of the at least one rolling stand, said center line extending in a rolling direction, comprising:

carrying out a first rolling pass of the plate by the at least one rolling stand;

detecting whether side faces of the plate are offset relative to each other in a rolling direction when the plate emerges from the at least one rolling stand;

centering the plate before a second rolling pass of the plate by the at least one rolling stand by abutting the plate with the first and second guiding elements in a centering position; and setting the first and second guiding elements asymmetrically relative to the center line in the second rolling pass if the side faces of the plates are offset relative to each other in the rolling direction, such that the first guiding element, for the side face which enters the rolling stand first in the second rolling pass, is further from the center line than the second guiding element.

5. The method as claimed in claim 4, further comprising keeping the second guiding element in its centering position for a side face which enters the at least one rolling stand second in the second rolling pass.

6. The method as claimed in claim 5, further comprising setting a tolerance gap having a width of a few centimeters between the first guiding element and a side face of the plate which is oriented towards it.

7. The method as claimed in claim 5, further comprising setting a tolerance gap having a width of 6 to 10 cm between the first guiding element and a side face of the plate which is oriented towards it.

8. The method as claimed in claim 4, further comprising:

measuring a rolling force on both a drive side and an operator side of the at least one rolling stand; and checking whether the side faces of the plate are offset relative to each other in the rolling direction.

9. The method as claimed in claim 4, further comprising resetting the first and second guiding elements symmetrically after the second side face has entered the at least one rolling stand.

10. The method as claimed in claim 4, further comprising:

arranging a plurality of rolling stands in a rolling direction; and setting first and second guiding elements of a respectively next rolling stand asymmetrically during an entry of the plate, if an offset of the side faces of the plate in the rolling direction is identified.

11. The method as claimed in claim 4, further comprising rolling the plate by at least one reversible rolling stand and adjusting guiding elements of the at least one reversible rolling stand when the rolling direction changes.

12. A non-transitory computer readable storage medium storing a computer program, which when executed by a control device for the at least one rolling stand causes the at least one rolling stand to be operated in accordance with the method as claimed in claim 4.

* * * * *